US007936244B2

(12) United States Patent
Hansen

(10) Patent No.: US 7,936,244 B2
(45) Date of Patent: May 3, 2011

(54) HIGHLY COUPLED INDUCTOR

(75) Inventor: Thomas T. Hansen, Yankton, SD (US)

(73) Assignee: Vishay Dale Electronics, Inc., Columbus, NE (US)

( * ) Notice: Subject to any disclaimer, the term of this patent is extended or adjusted under 35 U.S.C. 154(b) by 125 days.

(21) Appl. No.: 12/114,057

(22) Filed: May 2, 2008

(65) Prior Publication Data

US 2009/0273432 A1 Nov. 5, 2009

(51) Int. Cl.
*H01F 5/00* (2006.01)

(52) U.S. Cl. ..... 336/200

(58) Field of Classification Search ..... 336/65, 336/83, 170, 173, 178, 200, 212, 214–215, 336/192, 232, 84 R, 84 C
See application file for complete search history.

(56) References Cited

U.S. PATENT DOCUMENTS

| | | | | |
|---|---|---|---|---|
| 5,095,296 | A | 3/1992 | Parker | |
| 6,362,986 | B1 | 3/2002 | Schultz et al. | |
| 6,967,553 | B2 * | 11/2005 | Jitaru | 336/178 |
| 7,352,269 | B2 * | 4/2008 | Li et al. | 336/170 |
| 2003/0197585 | A1 * | 10/2003 | Chandrasekaran et al. | 336/178 |
| 2004/0080978 | A1 | 4/2004 | Jitaru | |
| 2004/0113741 | A1 | 6/2004 | Li et al. | |
| 2007/0252669 | A1 | 11/2007 | Hansen et al. | |

FOREIGN PATENT DOCUMENTS

| | | | |
|---|---|---|---|
| EP | 0 601 791 | A1 | 6/1994 |
| JP | 60106112 | A | 6/1985 |
| JP | 6016112 | A | 11/1985 |
| WO | 2007/123564 | A1 | 11/2007 |

OTHER PUBLICATIONS

Cooper Bussmann Coiltronics(TM), CPL Series Multi-Phase Power Inductors, product brochure (2006) (5 pages).
Czogalla, Jens et al., "Automotive Application of Multi-Phase Coupled-Inductor DC-DC Converter", IAS (2003) (6 pages).
Dixon, Lloyd, Coupled Filter Inductors in Multi-Output Buck Regulators (Topic 5), (11 pages).
Li, Jieli et al., "Coupled-Inductor Design Optimization for Fast-Response Low-Voltage DC-DC Converters", APEC 2002 (7 pages).

(Continued)

*Primary Examiner* — Tuyen Nguyen
(74) *Attorney, Agent, or Firm* — Volpe and Koenig, PC

(57) ABSTRACT

A highly coupled inductor includes a first ferromagnetic plate, a second ferromagnetic plate, a film adhesive between the first ferromagnetic plate and the second ferromagnetic plate, a first conductor between the first plate and the second plate, and a second conductor between the first plate and the second plate. A conducting electromagnetic shield may be positioned proximate the first conductor for enhancing coupling and reducing leakage flux. A method of manufacturing a highly coupled inductor component includes providing a first ferromagnetic plate and a second ferromagnetic plate, placing conductors between the first ferromagnetic plate and the second ferromagnetic plate, and connecting the first ferromagnetic plate and the second ferromagnetic plate using a film adhesive.

17 Claims, 5 Drawing Sheets

OTHER PUBLICATIONS

Li, Jieli et al., "Using Coupled Inductors to Enhance Transient Performance of Multi-Phase Buck Converters", power point presentation, Volterra, 2004 Intel Technology Symposium (25 pages).

Nan, Xi et al., "An Improved Calculation of Proximity-Effect Loss in High-Frequency Windings of Round Conductors", PESC 2003 (8 pages).

Wong, Pit-Leong et al., "Investigating Coupling Inductors in the Interleaving QSW VRM", Center for Power Electronics Systems, The Bradley Dept. of Electrical and Computer Engineering, Virginia Polytechnic Institute and State University, Blacksburg, VA 24061 USA (2000) (6 pages).

SMT Power Inductors, Power Beads—PA131xNL Series Coupled Inductors, Pulse, catalog pages, pulseeng.com. P636.A (Nov. 2005) (2 pages).

Zumel, P., et al., "Magnetic Integration for Interleaved Converts", abstract Universidad Politecnica de Madrid, E.T.S.I. Industriales, Division de Ingenieria Electronica, C/Jose Gutierrez Abascal, 2.28006 Madrid. Spain, 2003, pp. 1143-1149.

International Search Report From Counterpart Foreign Application No. PCT/US2008/063572.

* cited by examiner

HIGHLY COUPLED INDUCTOR

FIELD OF THE INVENTION

The present invention relates to inductors. More particularly, the present invention relates to highly coupled inductors.

BACKGROUND OF THE INVENTION

Coupled inductors have been in existence for several decades, but are seldom used for circuit boards. That is now changing, as more powerful computer microprocessors require high current on small boards. Coupled inductors can be used to decrease the amount of board space consumed by traditional inductors. They have also been shown to significantly reduce ripple currents and have allowed the use of smaller capacitors, saving board space. Thus, what is needed is an efficient, high coupling coefficient, reasonably low cost inductor.

Therefore, it is a primary object, feature, or advantage of the present invention to improve over the state of the art.

It is a further object, feature, or advantage of the present invention to provide a highly coupled inductor which is efficient.

One or more of these and/or other objects, features, or advantages of the present invention will become apparent from the specification and claims that follow.

BRIEF SUMMARY OF THE INVENTION

According to one aspect of the present invention, a highly coupled inductor is provided. The inductor includes a first ferromagnetic plate, a second ferromagnetic plate, a film adhesive between the first ferromagnetic plate and the second ferromagnetic plate, a first conductor between the first plate and the second plate, a second conductor between the first plate and the second plate, and a conducting electromagnetic shield proximate the first conductor for enhancing coupling and reducing leakage flux.

According to another aspect of the present invention, a multi-phased coupled inductor with enhanced effecting coupling includes a first ferromagnetic plate having a plurality of posts, a second ferromagnetic plate, a plurality of conductors, each of the plurality of conductors between two or more of the plurality of posts of the first ferromagnetic plate. Each of the plurality of conductors is positioned between the first ferromagnetic plate and the second ferromagnetic plate.

According to another aspect of the present invention, a method of manufacturing a highly coupled inductor includes providing a first ferromagnetic plate and a second ferromagnetic plate, placing conductors between the first ferromagnetic plate and the second ferromagnetic plate, and connecting the first ferromagnetic plate and the second ferromagnetic plate using a film adhesive.

DETAILED DESCRIPTION OF THE PREFERRED EMBODIMENT

The present invention provides for efficient, high coupling coefficient, low cost coupled inductors. According to various embodiments, two pieces of ferromagnetic plates are spaced by thin film adhesive. Conductors are placed at strategic locations to provide for higher coupling and/or to change coupling phase. The use of the adhesive has a dual role in the effectiveness of the component. Film adhesive thickness is selected to raise or lower the inductance of the part. Small adhesive thickness creates an inductor with a high inductance level. A thick adhesive reduces the inductance of the part and increases magnetic saturation resistance to high input current. Thus, the adhesive thickness can be selected to tailor the inductance of the part for a specific application. The second role of the adhesive is to bind the parts together making the assembly robust to mechanical loads.

Figure 1:
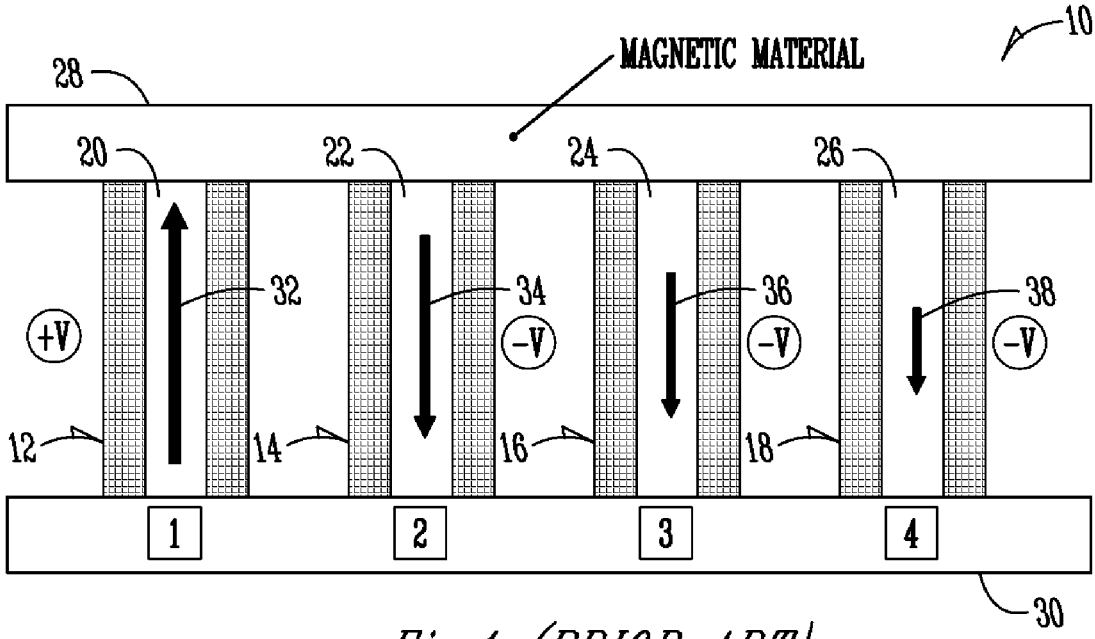
Fig.1 (PRIOR ART)
FIG. 1 is prior art illustrating a four phase coupled inductor.

FIG. 1 is a representation of a prior art four-phase coupled inductor. The inductor 10 has four coils 12, 14, 16, 18 wound in the same direction and placed over ferromagnetic posts 20, 22, 24, 26. All the posts 20, 22, 24, 26 are tied together with a ferromagnetic top plate 28 and a ferromagnetic bottom plate 30. A high-speed switch is closed applying a pulse voltage to the first coil 12. The voltage induces a current creating a magnetic flux shown by the arrow 32 in the direction shown. Due to its proximity, the post 22 of the second coil 14 receives the greatest amount of magnetic flux. The magnetic flux in the posts 24, 26 of the last two coils 16, 18 decreases the farther away they are from the first coil 12. Magnetic flux induces a voltage in each of the coils 16, 18 in the opposite direction to the applied voltage as indicated by arrows 36, 38. The coupling is out-of-phase to the applied voltage pulse from the first coil 12.

Figure 2:
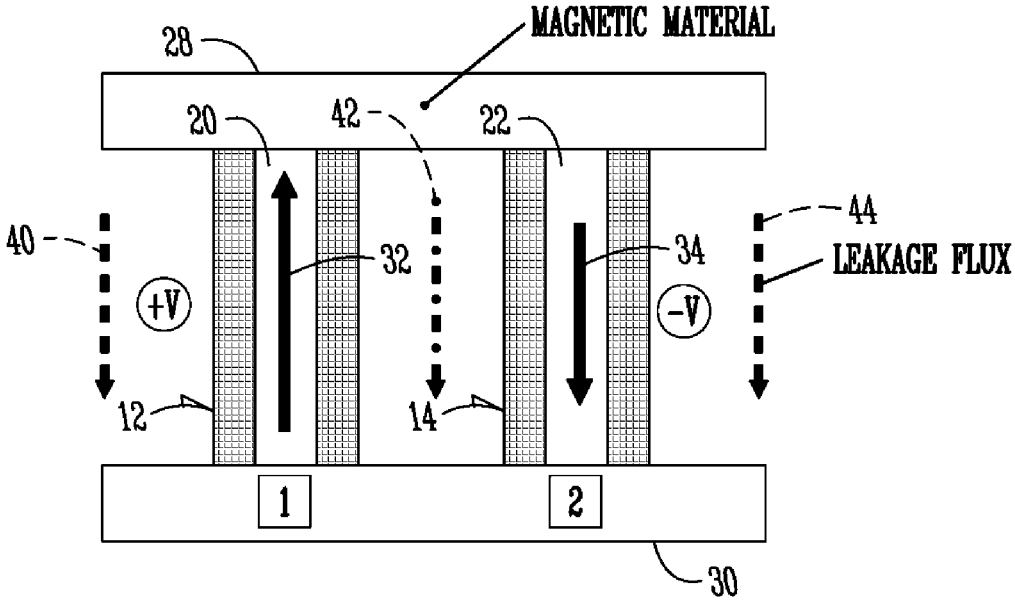
Fig.2 (PRIOR ART)
FIG. 2 is prior art illustrating of a two phase coupled inductor.

While existing coupled inductors do reduce ripple voltage, their effectiveness is reduced by leakage flux. FIG. 2 is an illustration of a two phase coupled inductor showing flux leakage. A voltage pulse is applied to a first coil 20 inducing a magnetic field. As the magnetic flux (indicated by an arrow 32) leaves the first coil 20 most of it flows through the center leg of a second coil 22 (as indicated by arrow 34). A portion of the magnetic flux will leak out and not go through the second coil 22 therefore is not "sensed" by it. This leakage flux is indicated by arrows 40, 42, 44. Leakage flux reduces the coupling or the magnitude of voltage sensed by the other conductor. Hence, at issue with coupled inductors today is low coupling between the adjoining leg or legs of multi-phase coupled inductors. Low coupling reduces the inductor's ability to reduce ripple currents. What is needed is a low cost, low DC resistance coupled inductor solution with improved coupling for two or more phased inductors.

Figure 3:
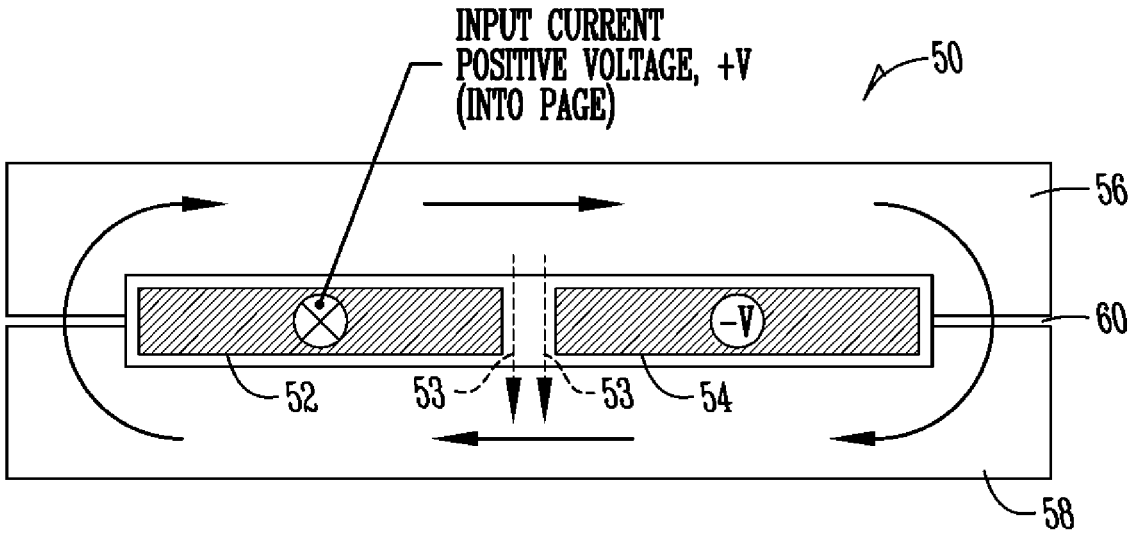
FIG. 3 is a two-phase coupled inductor according to one embodiment of the present invention.

Ferromagnetic plates can be made from any magnetically soft material such as, but not limited to, ferrite, molypermalloy (MPP), Sendust, Hi Flux or pressed iron. FIG. 3 is an illustration of a one embodiment of a two phase coupled inductor 50 according to the present invention. Two parallel strips of conductor 52, 54 are used in the inductor. A positive voltage, +V, is applied to the first conductor 52 inducing a current. Magnetic flux is generated and flows around the second conductor 54. Some magnetic flux leakage occurs between the conductors as indicated by arrows 53. The voltage induced in the second conductor 54 is out-of-phase with the voltage applied to the first conductor 52. Coupling between the conductors 52, 54 is good and is much greater than known existing coupled inductor designs.

Figure 4:
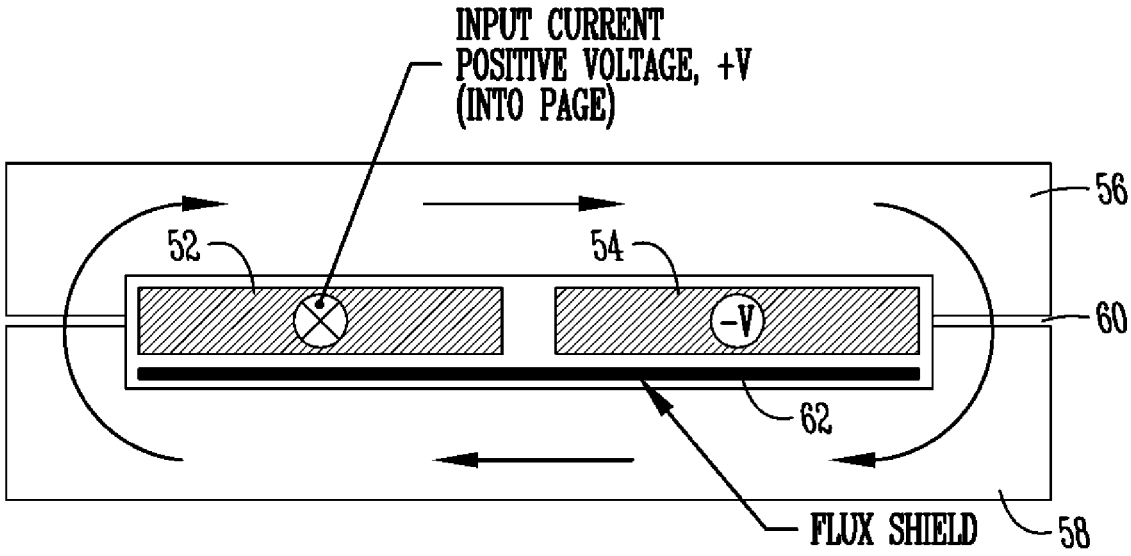
FIG. 4 is a two-phase coupled inductor with flux shield according to another embodiment of the present invention.

Coupling (voltage induced in the other conductor) can be significantly increased by placing an electrically conductive plate (flux shield) either above or below the conductors. FIG. 4 illustrates a flux shield 62 placed beneath the conductors 52, 54. The flux shield 62 may alternatively be placed above the conductors 52, 54, or else a flux shield may be placed both above and below the conductors 52, 54.

Where voltage is applied at high frequencies, the conductive plate has high intensity eddy currents induced at its surface. This prevents leakage flux from moving between conductors and effectively forces the magnetic flux to flow in the ferromagnetic parts around the conductors thereby increasing magnetic coupling between the conductors.

Figure 5:
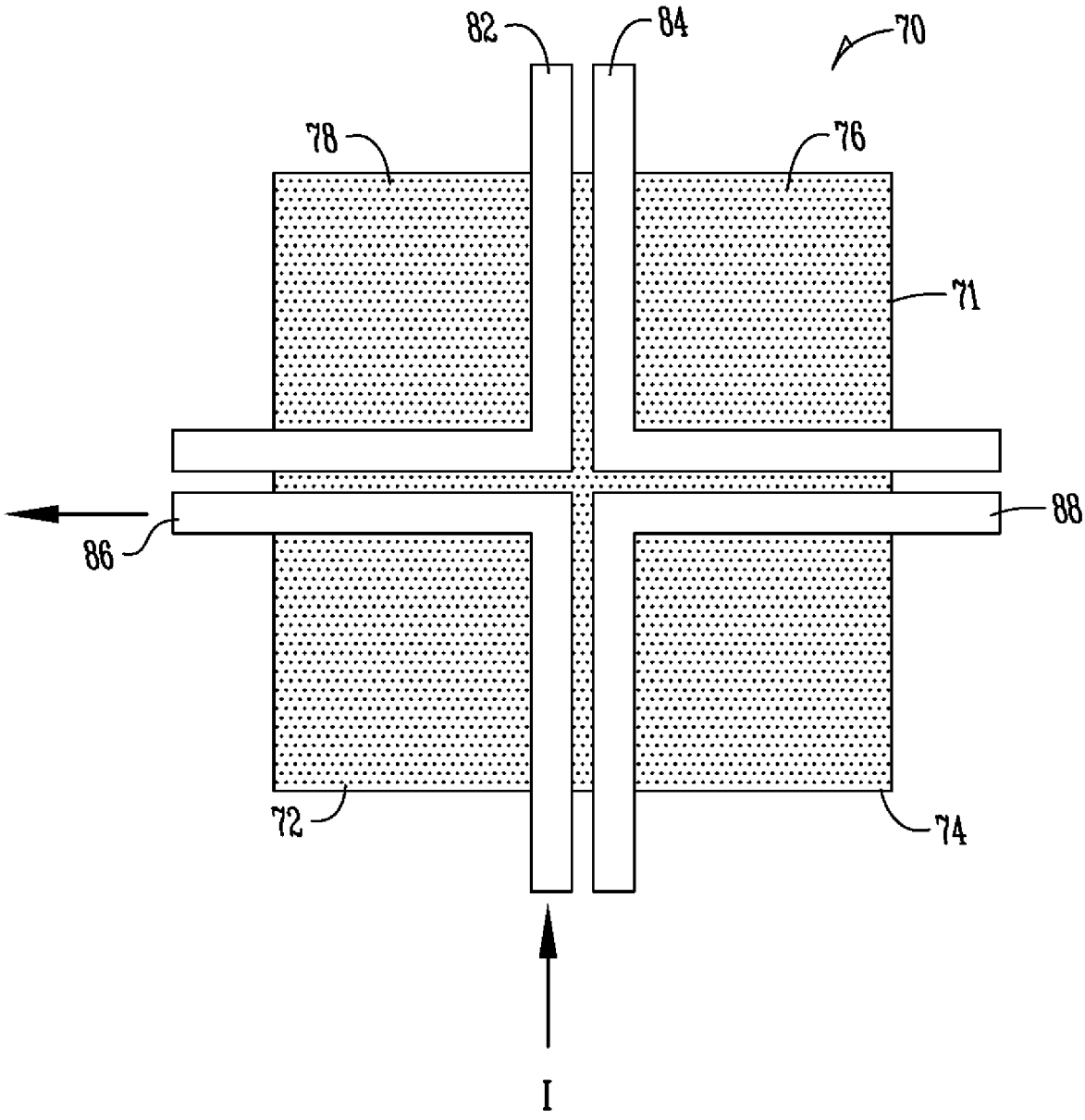
FIG. 5 is top view of a four-phase coupled inductor according to one embodiment of the present invention.

FIG. 5 represents a new four-phase coupled inductor design for an inductor 70. The inductor has a ferromagnetic plate 71 multiple posts 72, 74, 76, 78 in close proximity to each other and with a conductor 82, 84, 86, 88 associated with each post for forming multiple inductor components. This enhances the effective coupling between inductor components and has a near equal magnetic flux distribution. The first inductor component formed using the first post 72 of FIG. 5 is energized with the application of positive voltage to the conductor 86 thereby creating a positive input current. The current induces a magnetic field that flows through the inductors formed using the second post 74, the third post 78, and the fourth post 76 with almost equal magnitudes. Due to their proximity to the source, magnetic flux leakage is minimized and thus coupling becomes much greater than prior art devices. Coupling is further increased by placing an electrically conducting sheet in between all of the inductors. This feature acts as a magnetic shield preventing leakage flux from escaping through the gaps between the conductors. Not shown in FIG. 5 is a second ferromagnetic plate which is bonded to the top of the features shown. The inductance of this configuration can be increased or decreased by varying thin film adhesive thickness.

The present invention and various embodiments with, two, four or more phased coupled inductors, differ significantly from prior art. A thin film adhesive is used to set the air gap that determines the inductance level of the part and join the ferromagnetic plates together. The use of a conducting electromagnetic shield to improve coupling has never been used for coupled inductors. In particular for the two-phase inductor, magnetic flux does not flow through a closed loop conductor. The magnetic flux is coupled from one conductor to another via traveling around each other.

Existing out-of-phase coupled inductors have inductive components in a linear line with the first and last inductor component being placed at a considerable distance relative to each other. The new four-phase inductor as outlined has all four inductive components in close proximity to each other allowing even distribution of magnetic flux, and higher total coupling. Coupling is further improved by introducing an electrically conducting sheet between inductive components. The sheet prevents magnetic flux leakage and enhances overall performance.

Figure 6:
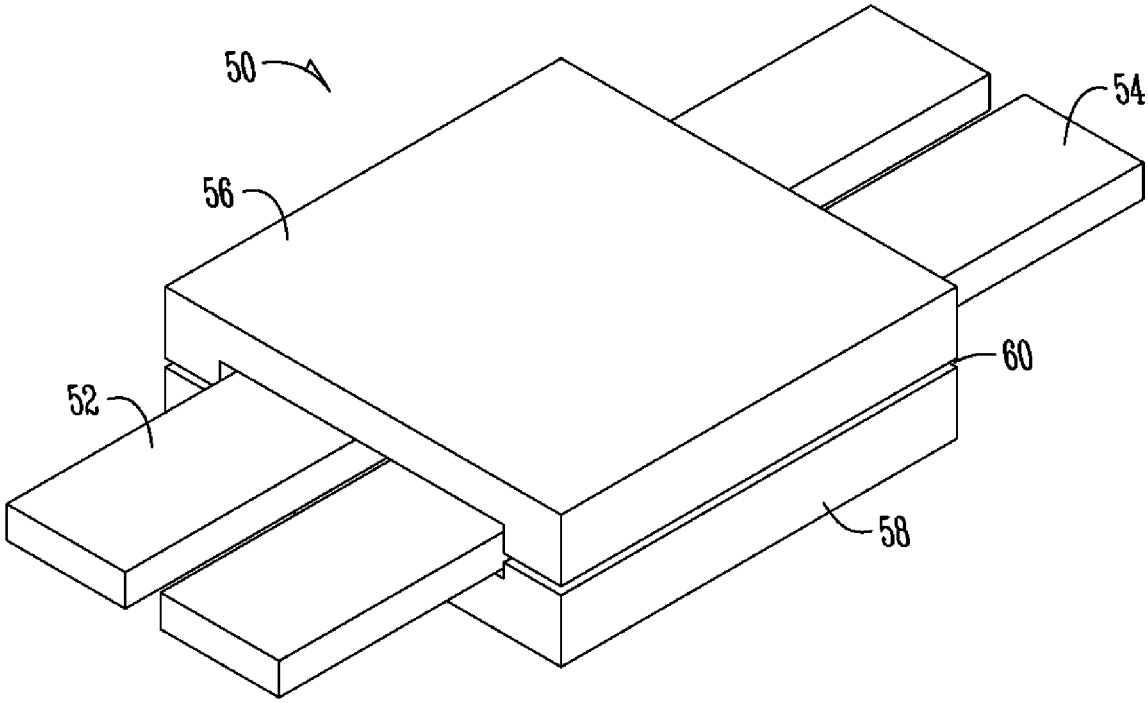
FIG. 6 is a two phase coupled inductor.
Figure 7:
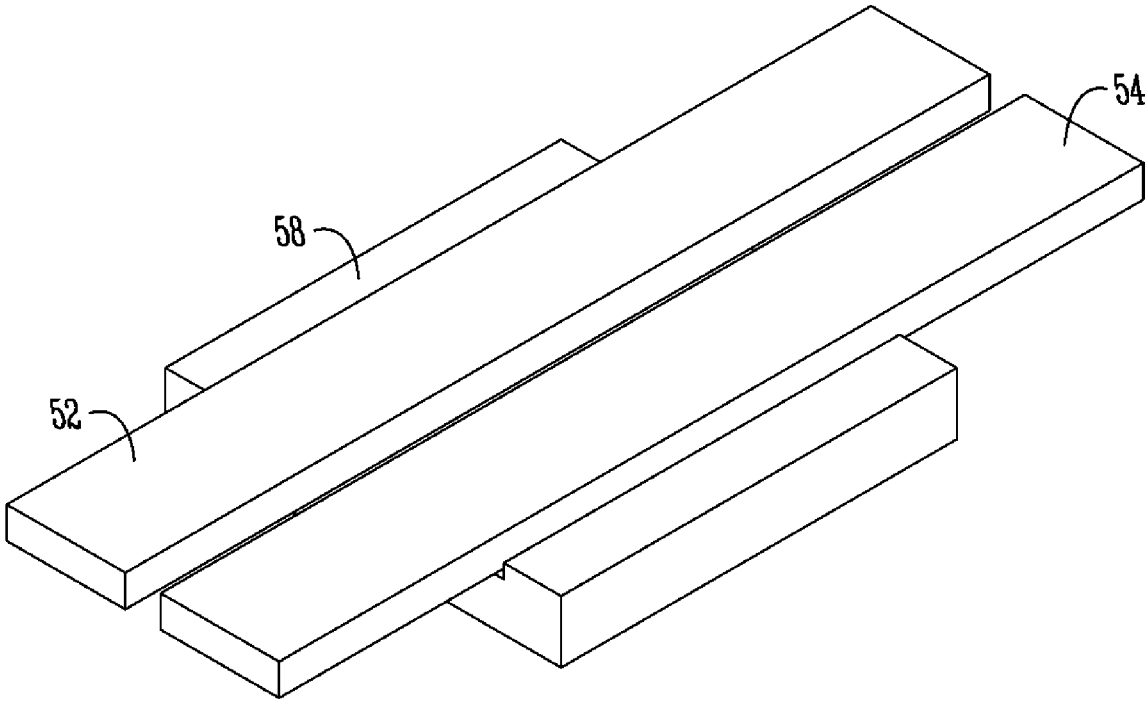
FIG. 7 is a two phase coupled inductor.

FIG. 6 and FIG. 7 illustrate a two-phase coupled surface mount inductor according to one embodiment of the present invention. In FIG. 6, a two-phase coupled surface mount inductor 50 is shown. The two-phase coupled surface mount inductor 50 has two ferromagnetic plates 56, 58 combined together by a distance set by the thickness of a thin film adhesive 60. Parallel conductors 52, 54 are placed in a lengthwise manner. Electrical current enters the first conductor 52 flowing through the component, for example. Magnetic flux is generated using the right hand rule with the thumb pointing in the direction of the current. The right hand rule shows the interior of the loop has magnetic flux flowing over outside the second conductor. Each conductor 52, 54 is coupled to the magnetic flux and a voltage is induced in response to the magnetic field. A thin sheet of insulated electrically conducting material covering the conductors (not shown) is placed above, below or at both locations to limit leakage flux by means of eddy current shielding. The presence of strong surface eddy currents prevents magnetic flux to flow through the sheet. The conductors 52, 54 may be curled over one or both sides of the ferromagnetic plates 56, 58. This allows users to readily attach the component to an electrical board. The invention may have multiple termination configurations.

The conductors do not have to be parallel strips spaced on the same plane as illustrated in FIG. 6 and FIG. 7. Alternative designs include multiple conductors placed on top or bottom of each other. These conductors can be placed in multiple layers and multiple layer stacks. Stacking electrically insulated conductors lowers the DC resistance and prevents magnetic flux leakage that would be present if the conductors lay side by side.

Analysis have been performed on the effectiveness of the electrically conducting material introduced into the design. There is high magnetic flux leakage without the shield between the conductors. When the shield is introduced, leakage is considerably reduced at frequencies above 100 kHz, which dramatically increases the coupling between conductors.

Figure 8:
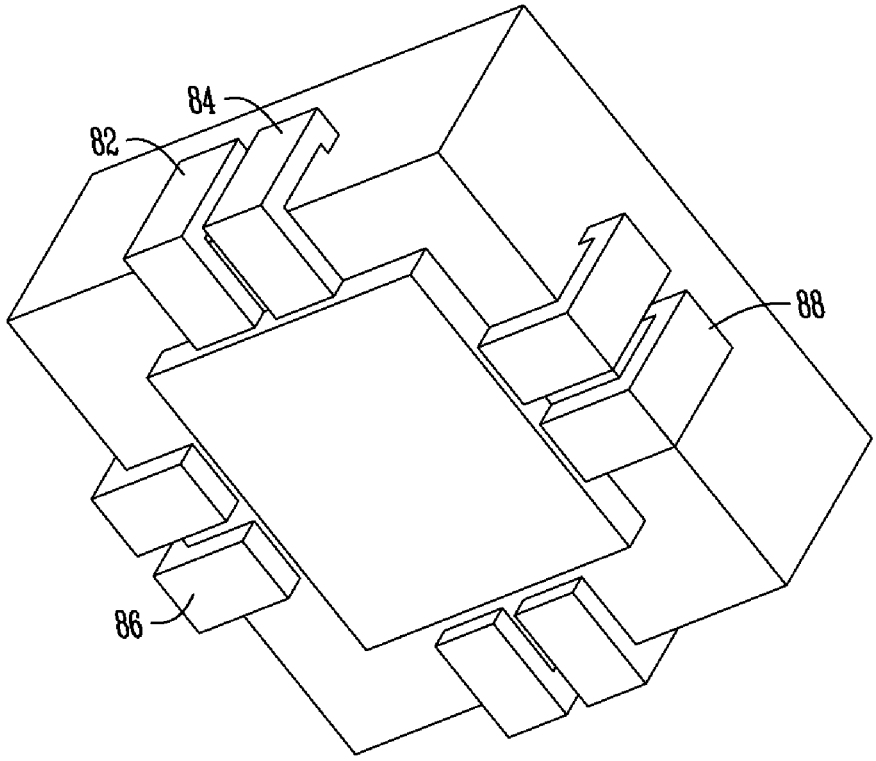
FIG. 8 is a four phase coupled inductor.
Figure 9:
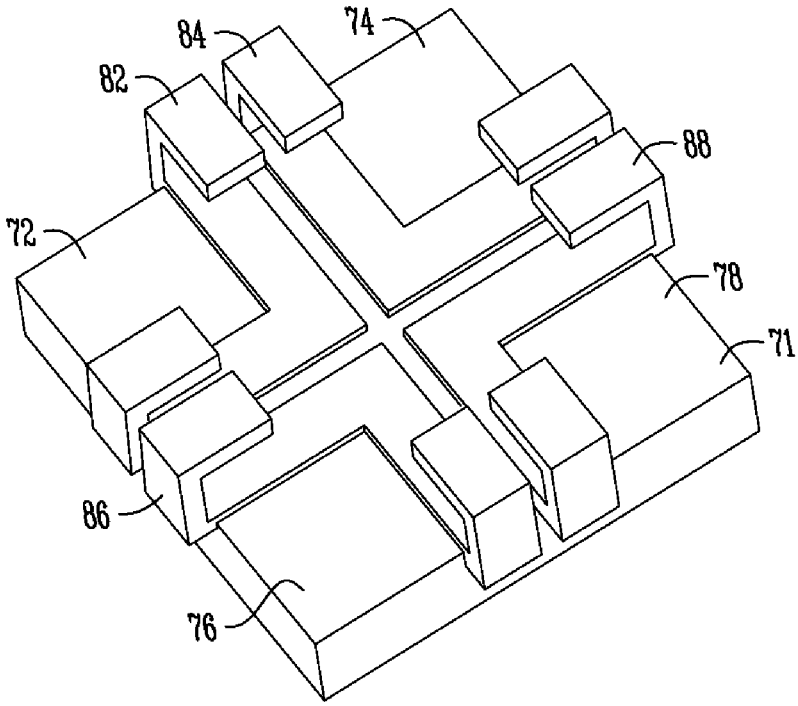
FIG. 9 is a four phase coupled inductor with detail.

FIG. 8 and FIG. 9 illustrate a four-phase surface mount inductor can be constructed. Four L-shaped conductors, 84, 86, 88 are positioned around ferromagnetic posts 72, 74, 76, 78 of a ferromagnetic plate 71. The ferromagnetic posts are in close proximity to each other. Note that the arrangement of the ferromagnetic posts shown is in a 2×2 configuration, although other configurations may be used. Note that the arrangement is not a fully linear arrangement conventionally associated with coupled inductors. The leads are bent around the ferromagnetic plates to be soldered to an electrical board. A shield can be placed between the posts to reduce leakage flux. The magnetic flux density effect with and without a conducting shield has been examined. There is higher leakage flux between the conductors when the shield is not present. Thus, the use of the shield reduces leakage flux.

Therefore efficient, highly coupled inductors have been described. The present invention contemplates that varying number of inductors may be coupled, leads of conductors may or may not be bent around ferromagnetic plates, different numbers of posts of ferromagnetic material may be used, and other variations. The present invention is not to be limited to the specific embodiments shown.

What is claimed is:

1. A highly coupled inductor, comprising:

a first ferromagnetic plate;

a second ferromagnetic plate;

a film adhesive between the first ferromagnetic plate and the second ferromagnetic plate;

a first conductor arranged between the first ferromagnetic plate and the second ferromagnetic plate;

a second conductor arranged at a distance from the first conductor between the first ferromagnetic plate and the second ferromagnetic plate; and a single conducting electromagnetic shield sandwiched between one of the ferromagnetic plates and both of the first and second conductors, spanning the distance between the first and second conductors, for enhancing coupling and reducing leakage flux.

2. The highly coupled inductor of claim 1 further comprising a second conducting electromagnetic shield sandwiched between the other one of the ferromagnetic plates and both of the first and second conductors for reducing leakage flux.

3. The highly coupled inductor of claim 2 wherein the first conducting electromagnetic shield is above the first conductor and the second conductor and wherein the second conducting electromagnetic shield is below the first conductor and the second conductor.

4. The highly coupled inductor of claim 1 wherein the first conductor is parallel with the second conductor.

5. The highly coupled inductor of claim 1 wherein the first ferromagnetic plate is configured to provide four ferromagnetic posts with the first conductor between a first of the ferromagnetic posts and a second, a third, and a fourth of the ferromagnetic posts.

6. The highly coupled inductor of claim 5 wherein the second conductor is disposed between the second of the ferromagnetic posts and the first, third, and fourth of the ferromagnetic posts.

7. The highly coupled inductor of claim 6 further comprising a third conductor disposed between the third of the ferromagnetic posts and the first, second, and fourth of the ferromagnetic posts.

8. The highly coupled inductor of claim 7 further comprising a fourth conductor disposed between the fourth of the ferromagnetic posts and the first, second, and third of the ferromagnetic posts.

9. The highly coupled inductor of claim 8 wherein the electromagnetic shield is formed of an electrically conducting sheet disposed between at least two of the ferromagnetic posts to enhance coupling and reduce magnetic flux leakage.

10. The highly inductor of claim 8 wherein each of the conductors is L-shaped.

11. The highly coupled inductor of claim 10 wherein each conductor further comprises ends bent around the second ferromagnetic plate to provide terminals for connection.

12. A multi-phased coupled inductor with enhanced effecting coupling, comprising:

a first ferromagnetic plate having a plurality of posts;

a second ferromagnetic plate;

a plurality of conductors, each one of the plurality of conductors arranged between two or more of the plurality of posts of the first ferromagnetic plate;

wherein each of the plurality of conductors is positioned between the first ferromagnetic plate and the second ferromagnetic plate, and a single conducting electromagnetic shield is sandwiched between at least two of the plurality of posts and at least two adjacent ones of the plurality of conductors to enhance coupling and reduce magnetic flux leakage.

13. The multi-phased coupled inductor of claim 12, wherein the conducting electromagnetic shield is formed as an electrically conducting sheet.

14. The multi-phased coupled inductor of claim 12 wherein the plurality of posts are configured in a 2×2 array.

15. The multi-phased coupled inductor of claim 12 wherein each conductor is substantially L-shaped.

16. The multi-phased coupled inductor of claim 15 wherein each conductor further comprises ends bent around one of the first and the second ferromagnetic plates to provide terminals for connection.

17. The multi-phased coupled inductor of claim 12 further comprising a film adhesive 10 between the first ferromagnetic plate and the second ferromagnetic plate.

* * * * *